US008443497B2

(12) United States Patent
Hobstetter

(10) Patent No.: US 8,443,497 B2
(45) Date of Patent: May 21, 2013

(54) TRANSFORMATION OF A CREMATION CONTAINER FOR DISPLAY

(76) Inventor: John Norman Hobstetter, Kettering, OH (US)

( * ) Notice: Subject to any disclaimer, the term of this patent is extended or adjusted under 35 U.S.C. 154(b) by 0 days.

(21) Appl. No.: 13/252,361

(22) Filed: Oct. 4, 2011

(65) Prior Publication Data

US 2012/0084952 A1 Apr. 12, 2012

Related U.S. Application Data

(60) Provisional application No. 61/390,455, filed on Oct. 6, 2010.

(51) Int. Cl.
*A61G 17/00* (2006.01)

(52) U.S. Cl.
USPC ..... 27/19; 27/1; 27/4

(58) Field of Classification Search
USPC ..... 27/1, 2, 4, 14, 17, 19, 35; 229/198.2, 229/198.3, 199, 199.1, 164.1, 164.2
See application file for complete search history.

(56) References Cited

U.S. PATENT DOCUMENTS

| | | | | |
|---|---|---|---|---|
| 820,744 | A * | 5/1906 | Smith | 27/9 |
| 1,998,269 | A | 4/1935 | Brown | |
| 2,289,406 | A | 7/1942 | Beranek | |
| 3,133,334 | A | 5/1964 | Johnsen | |
| 3,613,189 | A | 10/1971 | Kirby | |
| 3,654,676 | A | 4/1972 | McHugh | |
| 3,810,282 | A * | 5/1974 | Doggett | 27/35 |
| 3,815,185 | A | 6/1974 | Owens | |
| 4,063,337 | A | 12/1977 | Havey, III | |
| 4,139,929 | A | 2/1979 | Angermann | |
| 4,151,630 | A | 5/1979 | Havey | |
| 4,177,543 | A | 12/1979 | Angermann | |
| 4,249,289 | A | 2/1981 | Work | |
| 4,265,006 | A | 5/1981 | Angermann | |
| 4,337,556 | A | 7/1982 | Winburn et al. | |
| 4,788,757 | A | 12/1988 | Bethune et al. | |
| 4,800,631 | A * | 1/1989 | Pellmann | 27/7 |

(Continued)

FOREIGN PATENT DOCUMENTS

WO WO 2010126145 A1 * 11/2010

OTHER PUBLICATIONS www.crematorium.eu, "26 Questtions about cremation", http://crematorium.eu/26_questtions_about_cremation.html, downloaded Aug. 22, 2011.

(Continued)

*Primary Examiner* — William L. Miller
(74) *Attorney, Agent, or Firm* — Thomas E. Lees, LLC

(57) ABSTRACT

A kit for transforming a cremation container into a casket for display comprises a frame and a canopy. The frame includes a head end section, a right side section, and a left side section. Moreover, each section has a top surface, a bottom surface and a continuous channel along the bottom surface. The frame seats over the cremation container such that the channel of the head end section receives a rim of an end panel of the cremation container, the channel of the right side section receives a rim of a right side panel of the cremation container and the channel of the left side section receives a rim of a left side panel of the cremation container. The canopy temporarily overlies at least a portion of the cremation container.

18 Claims, 11 Drawing Sheets

U.S. PATENT DOCUMENTS

| | | | | |
|---|---|---|---|---|
| 5,307,545 | A * | 5/1994 | Stoltz | 27/4 |
| 5,481,785 | A | 1/1996 | Minton et al. | |
| 5,485,661 | A * | 1/1996 | McClure | 27/7 |
| 5,592,723 | A | 1/1997 | Leijonhufvud et al. | |
| 5,740,592 | A * | 4/1998 | Lau | 27/4 |
| 5,771,548 | A * | 6/1998 | Jenkins | 27/2 |
| 5,784,768 | A | 7/1998 | Rojdev | |
| 5,996,197 | A * | 12/1999 | Jurkovic | 27/2 |
| 6,018,853 | A * | 2/2000 | Chen et al. | 27/2 |
| 6,145,175 | A | 11/2000 | Enneking et al. | |
| 6,497,018 | B1 * | 12/2002 | Chiu et al. | 27/2 |
| 6,574,840 | B1 * | 6/2003 | Doppel | 27/2 |
| 7,003,855 | B2 | 2/2006 | Lew | |
| 7,069,627 | B2 * | 7/2006 | Cunningham et al. | 27/19 |
| 7,263,751 | B2 | 9/2007 | Davis et al. | |
| 7,272,875 | B2 * | 9/2007 | Bovard et al. | 27/19 |
| 7,350,278 | B2 | 4/2008 | Davis et al. | |

OTHER PUBLICATIONS

Chilterns Crematorium, Chilterns crematorium Online, Frequently Asked Questions, http://www.chiltern.gov.uk/chilternscrematorium/site/scripts/faqs.php?categoryID=9&faqID, downloaded Aug. 9, 2011.

Joseph A. Hey & Son Ltd., "The Coffin Cover", http://www.funeralsearch.co.uk/coffin-cover.php, downloaded Aug. 9, 2011.

Natural Endings Ltd., www.naturalendings.co.uk, "About Cardboard Coffins", http://www.naturalendings.co.uk/cardboard-coffins.asp, downloaded Aug. 10, 2011.

Leaving Lightly Pty. Ltd., "Cardboard Coffins questions answered", Frequently Asked Questions, http://cardboardcoffinsaustralia.com.au/casketquestions.html, downloaded Aug. 10, 2011.

Eternity International Inc., "Eternity Cardboard Casket", http://www.eeternity.com/Product.html, downloaded Aug. 10, 2011.

* cited by examiner

TRANSFORMATION OF A CREMATION CONTAINER FOR DISPLAY

CROSS-REFERENCE TO RELATED APPLICATIONS

This application claims to the benefit of U.S. Provisional Patent Application Ser. No. 61/390,455, filed Oct. 6, 2010, entitled "TRIM PACKAGE FOR A CREMATION CONTAINER" by Hobstetter, the disclosure of which is hereby incorporated by reference.

BACKGROUND

Various aspects of the present invention relate generally to cremation containers and more specifically to the temporary transformation of a cremation container for display.

Customs for remembering the life of a person who has recently died vary widely between cultures and between religious affiliations within cultures. A common custom in the United States is a "visitation" (also commonly known as a viewing, wake or calling hours), where friends and family gather together to pay their last respects and share remembrances in the presence of the body of the deceased. At the visitation, the body of the deceased person is typically placed in a casket. The casket may be open to display the body, or the casket may be closed. When the visitation is over, the body of the deceased, along with the container, is usually buried in the ground or cremated.

In the United States, several state and local laws include a provision that any portion of the container that touches the body of the deceased must be buried or destroyed. As such, the container is usually a single-use container. Further, state and local laws typically include minimum requirements for containers for use in a cremation process. However, such laws typically allow a cremation container as simple as a cardboard box to be used.

BRIEF SUMMARY

According to aspects of the present invention, a kit for transforming a cremation container for display comprises a frame and a canopy. The frame includes a head end section, a right side section, and a left side section. Moreover, each section has a bottom surface and a continuous channel along the bottom surface. The frame seats over the cremation container such that the channel of the head end section receives a rim of an end panel of the cremation container, the channel of the right side section receives a rim of a right side panel of the cremation container and the channel of the left side section receives a rim of a left side panel of the cremation container. The canopy temporarily overlies at least a portion of the cremation container and detachably couples to the frame. In this regard, the cremation container is temporarily transformed, e.g., into the appearance of a casket or other configuration suitable for display, such as at a memorial service for a deceased.

According to further aspects of the present invention, a system for presenting a body comprises a cremation container, a frame and a canopy. The cremation container includes a bottom, a left side panel coupled to the bottom, a right side panel coupled to the bottom, a head end panel coupled to the bottom, the left side panel and the right side panel and a foot end panel coupled to the bottom, the left panel and the right panel. As such, an interior space is created in the cremation container. The frame includes a head end section, a right side section, and a left side section. Moreover, each section includes a bottom surface and a continuous channel along the bottom surface. The frame seats over the cremation container such that the channel of the head end section receives a rim of the head end panel of the cremation container, the channel of the right side section receives a rim of a right side panel of the cremation container and the channel of the left side section receives a rim of a left side panel of the cremation container. The canopy temporarily overlies at least a portion of the cremation container and detachably couples to the frame.

According to yet further aspects of the present invention, a folding template comprises a left end, a right end, a dual spline located on the folding template generally equidistant from the left end and the right end defining a right side of the folding template and a left side of the folding template. The folding template also includes a left spline parallel to the dual spline located on the folding template between the dual spline and the left end, and a right spline parallel to the dual spline located on the folding template between the dual spline and the right end. A first coupler is coupled to the left side of the folding template and a second coupler, complementary to the first coupler, is coupled to the right side of the folding template.

For simplicity and clarity of illustration, elements shown in the figures have not necessarily been drawn to scale. For example, the dimensions of some of the elements may be exaggerated relative to other elements for clarity of discussion.

DETAILED DESCRIPTION

Various aspects of the present invention facilitate temporarily transforming the appearance of a cremation container into a faux casket or other configuration for display at a memorial service such as a funeral visitation. For instance, a cremation container as simple as a cardboard box is transformed to take on an altered appearance, e.g., to appear as a more elaborate and conventional casket or to take on some other desired configuration, for the duration of the memorial service. Further, the temporary transformation of the cremation container can be configured to provide an open or closed body viewing, and the overall appearance of the display can be customized or otherwise personalized, as described more fully herein. According to further aspects of the present invention, a kit is provided to temporarily transform a cremation container into a more elaborate display, such as to mimic a casket or to transform the appearance of the cremation container into another desired shape.

The description below includes references to elements using the "left" and "right" designations. Those words, "left" and "right," are used for convenience and clarity to indicate opposing elements, however the actual positioning of those elements may be on the left or right side regardless of the "left" or "right" designation, depending on the orientation of the indicated elements and/or perspective of the viewer of the indicated elements.

Figure 1:
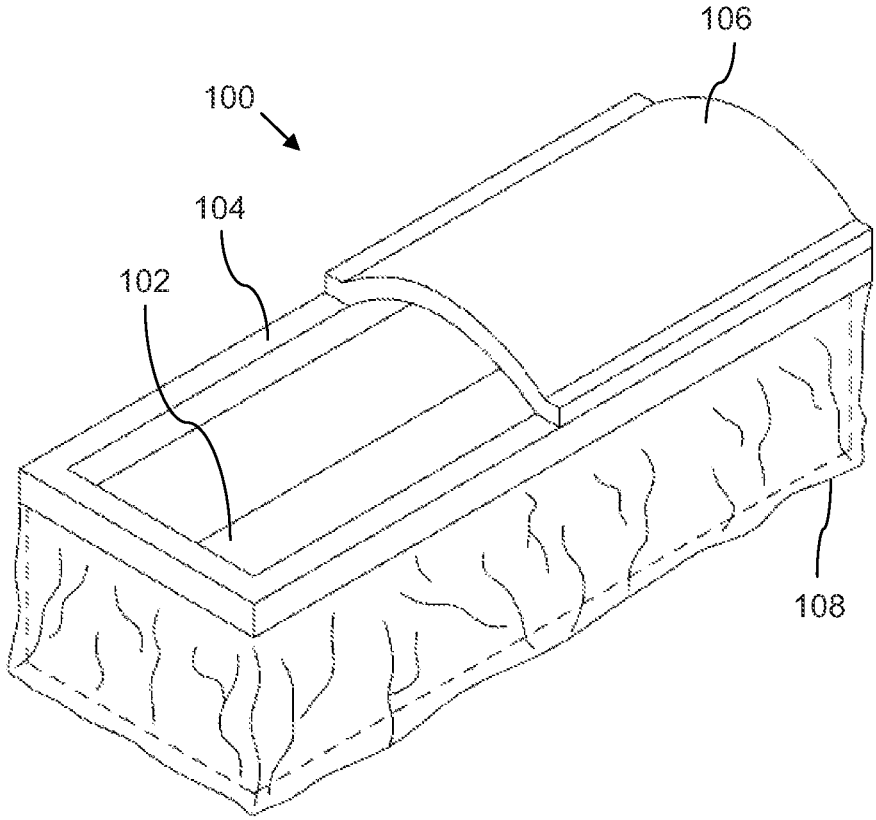
FIG. 1 is an isometric view of an assembled kit for transforming a cremation container into a faux casket for display, according to various aspects of the present invention.
Figure 3:
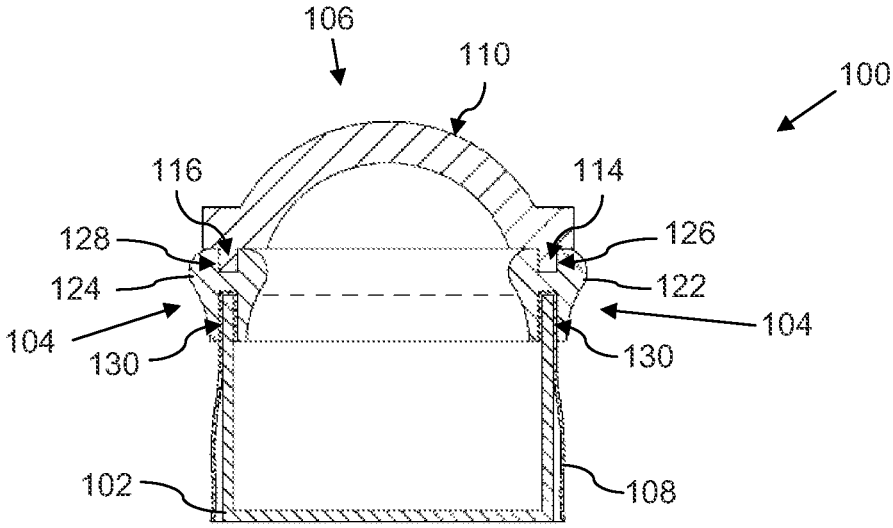
FIG. 3 is a cross-sectional view of the kit of FIGS. 1-2, according to various aspects of the present invention.
Figure 2:
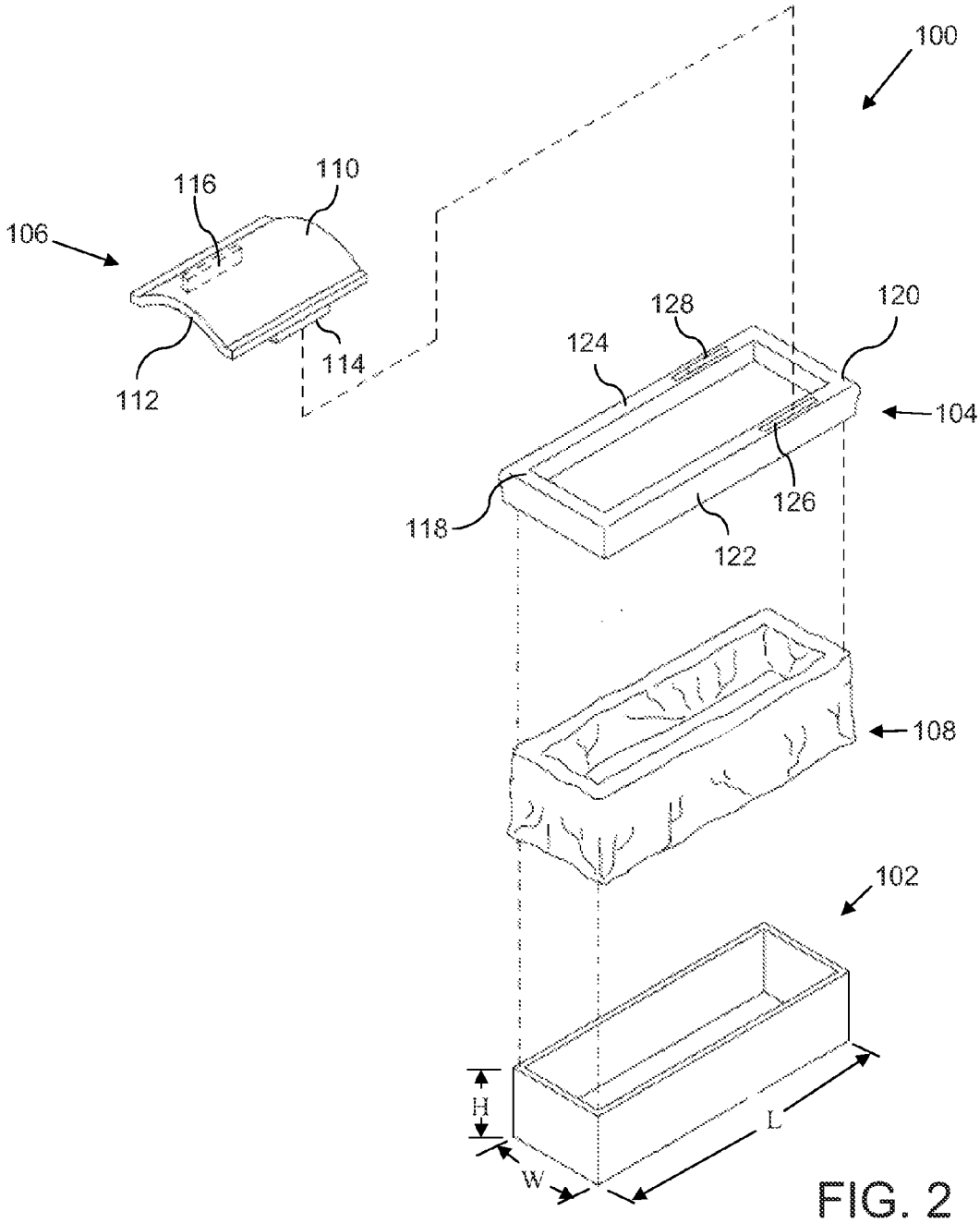
FIG. 2 is an exploded view of the kit of FIG. 1, according to various aspects of the present invention.

Turning now to the drawings and in particular to FIGS. 1-3, an exemplary kit 100 is illustrated, which is used for temporarily transforming a cremation container 102 into a display, such as for a memorial service. In the illustrated configuration, the kit 100 temporarily transforms the cremation container 102 into the appearance of a faux casket. However, other configurations may alternatively be implemented.

Referring particularly to FIG. 1, the exemplary kit 100 includes a frame 104 and a canopy 106, both of which temporarily/detachably couple to the cremation container 102, to transform the cremation container 102 into the appearance of a casket, as will be described in greater detail herein. In the illustrative implementation, the frame 104 simulates the aesthetic of top body molding that meets a rim/ogee of the canopy 106, which is configured in this example, to take on the appearance of a lid of a conventional casket. The frame 104 and the canopy 106 do not come into contact with the body of a deceased in the cremation container 102. As such, the frame 104 and canopy 106 are reusable.

In the illustrative implementation, the frame 104 does not touch or extend below the bottom panel of the cremation container 102. For instance, in FIG. 1, the bottom panel of the cremation container 102 is the generally horizontal surface upon which a body rests, as outlined by the dashed lines. Accordingly, as illustrated, the frame 104 does not conceal the entire side panels of the cremation container 102. However, a skirt 108 is placed at least partially around the cremation container 102 so as to extend down from the frame 104 to conceal, cover or otherwise apron one or more sides of the cremation container 102. In alternative implementations, the frame 104 may conceal one or more side panels of the cremation container 102.

Referring to FIG. 2, the cremation container 102, e.g., a cardboard box, has a length (L), a width (W) and a height (H) suitable to contain the body of a deceased person for burial or cremation. In general, cardboard panels of the cremation container 102 do not provide the aesthetic considered to be appropriate for a dignified and respectful funeral visitation. However, according to aspects of the present invention, the cardboard or other exterior of the cremation container 102 is temporarily transformed into a more dignified and/or personalized presentation by dressing the cremation container 102 with the frame 104, canopy 106 and skirt 108.

The frame 104 includes a bottom surface that seats down over the rim of the cremation container 102. The canopy 106 overlies and seats down over at least a portion of the frame 104, creating the appearance of a lid that extends a partial length (L) of the cremation container 102. In alternative implementations, the canopy 106 can take on the appearance of a lid that extends the full length (L) of the cremation container 102, or the canopy 106 can take on other configurations. The canopy 106 thus temporarily overlies at least a portion of the cremation container 102 and detachably couples to the frame 104 to provide a cover to the otherwise open top of the cremation container 102.

The skirt 108 covers at least the exterior side(s) of the cremation container 102. For instance, the skirt 108 can be temporarily coupled to the cremation container 102, e.g., by attaching to the frame 104. As another example, a portion of the material of the skirt 108 folds over the rim of the cremation container 102 and is held down by the frame 104, which seats onto the rim of the cremation container 102. For instance, the skirt 108 is illustrated as a one-piece fabric element that folds over the upper rim of the cremation container 102, and extends down to drape over the exterior side panels of the cremation container 102. In this manner, the exemplary skirt 108 wraps entirely around the outside of the cremation container 102.

In practice however, the skirt 108 can take on other configurations. For instance, the skirt 108 may be provided in two or more separate pieces that attach together or otherwise attach around the side panels of the cremation container 102, e.g., using snaps, zippers, a hook and loop fastener such as VELCRO brand fastener, a registered trademark of Velcro Industries B.V., etc. As such, each piece of the skirt 108 (where utilized) need only cover a portion of the cremation container 102. Additionally, in such cases, each piece of the skirt 108 is not required to be the same size; however, they may be if so desired. Further, in some embodiments, the skirt 108 extends further than the depth of the cremation container 102. This may be useful, for example, to create the appearance that the display has a greater overall height than the actual height (H) of the cremation container 102.

In the illustrative implementation, the canopy 106 includes a top surface 110 and a bottom surface 112. The top surface 110 includes a rim/ogee and a crown or generally arcuate center portion, thus taking on the shape of a conventional casket lid. Although not shown, the canopy 106 can include further optional details, such as a header, a fishtail to transition the crown to an ogee along the width (W) when seated on the cremation container 102, etc. The canopy 106 can also include other or alternative features to take on the shape desired to implement the personalized presentation. Further, as illustrated, the shape of the bottom surface 112 generally mimics the shape of the top surface 110. However, the shape of the bottom surface 112 does not necessarily have to mimic the shape of the top surface 110.

Additionally, the canopy 106 includes a right feature and a left feature, which are used to temporarily secure the canopy 106 to the frame 104. For instance, in the illustrated example, the right feature is implemented as a right tongue 114. Correspondingly, the left feature is implemented as a left tongue 116.

The exemplary frame 104 has a general shape and size that corresponds with the rim of the cremation container 102 and includes a head end section 118, a foot end section 120, a right side section 122, and a left side section 124. Each section of the frame 104 includes a bottom surface and a continuous channel that extends along the bottom surface. The channel along the bottom surface allows the frame 104 to seat over the rim of the cremation container 102. For instance, in an illustrative implementation, the frame 104 seats over the cremation container 102 such that the channel of the head end section 118 receives a rim of a first end panel of the cremation container 102, the channel of the foot end section 120 receives a rim of a second end panel opposite the first end panel of the cremation container. Similarly, the channel of the right side section 122 receives a rim of a right side panel of the cremation container 102 and the channel of the left side section 124 receives a rim of a left side panel of the cremation container 102.

Further, the right side section 122 includes a groove in the top surface thereof. Similarly, the left side section includes a groove 128 in a top surface thereof. The right tongue 114 of the canopy 106 fits into the top groove 126 of the right section 122 of the frame 104, and the left tongue 116 of the canopy 106 fits into the top groove 128 of the left section 124 of the frame 104. Alternatively, the canopy 106 can be integrated with the right and left sections 122, 124 of the frame 104 as one integral piece.

In some embodiments, the kit 100 includes an upper lid (not shown) that is similar to the canopy 106, except that the upper lid couples to the upper portions of the frame 104 in a manner similar to the canopy 106, e.g., to give the appearance of a closed casket. As another example, an upper lid can provide the aesthetic of an open lid, such as by coupling to only one side section to create the appearance of being hinged open.

Referring to FIG. 3, a cross-section view of the kit 100 is illustrated installed on a cremation container 102. The cross-section is taken along the width (W) and height (H) as noted in FIG. 2. As noted above, in certain illustrative implementations, the canopy 106 includes a right tongue 114 that seats into a groove 126 in the corresponding right side section 122 of the frame 106. Correspondingly, the canopy includes a left tongue 116 that seats into a groove 128 in the corresponding left side section 124 of the frame 106.

Also, as noted above, the frame 104 includes a channel along the bottom surface thereof for temporarily coupling to the cremation container. For instance, the right side section 122 of the frame 104 includes a bottom channel 130 that extends entirely along the length thereof. Similarly, the left side section 124 of the frame 104 includes a bottom channel 130 that extends entirely along the length thereof. As such, the frame 104 can be temporarily placed on the rim of the cremation container 102 in such a way that no tools or other special devices are required to assemble the frame 104 to the cremation container 102. Moreover, assembly of the frame 104 over the cremation container 102 is fast because the channels on the bottom of the frame sections simply slip over the rim of the cremation container 102. The shape of the frame 104 and the bottom channel are explained in greater detail below in reference to FIGS. 4-6. Still further, each section of the frame 104 is generally balanced on the corresponding rim of the cremation container 102.

In the illustrated implementation, the skirt 108 folds over the rim of the cremation container 102 such that the skirt 108 is between the frame 104 and the rim of the cremation container 102. Thus, the bottom groove 130 on the various sections 118, 120, 122, 124 of the frame 104 couples with the rim of the cremation container 102 over the skirt 108. When assembling the exemplary kit 100, a user places the skirt 108 on the rim of the cremation container 102, places the frame 104 on the rim of the cremation container 102 over the skirt 108 by inserting the channel 130 over the rim, and couples the canopy 106 to the frame 104 by inserting the tongues 114, 116 into the corresponding grooves 126, 128 of the side sections 122, 124 of the frame 104. In this regard, the canopy 106 provides structural strength and integrity to the kit by bridging and securing the right and left side sections 122, 124 of the frame 104.

Figure 4A:
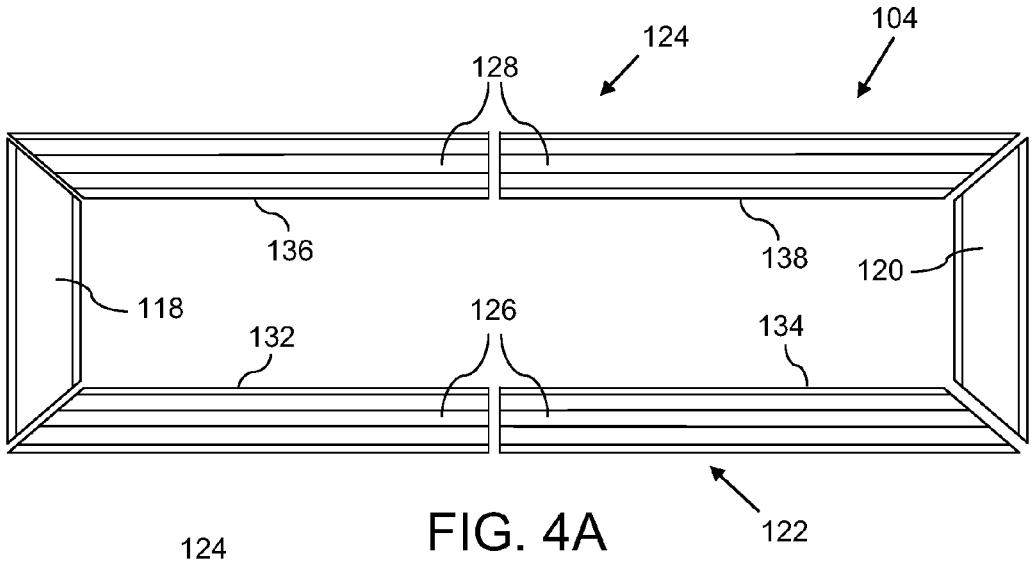
FIG. 4A is a top view of an exemplary frame of the kit, according to various aspects of the present invention.

Turning now to FIG. 4A, an exemplary frame 104 is shown according to further aspects of the present invention. As an alternative to implementing the frame 104 as one fully integrated piece as shown in FIG. 2, the illustrated frame 104 is several separate pieces that, when assembled, form the frame 104. As shown in the exemplary embodiment of FIG. 4A, the frame 104 includes the head end section 118 and the foot end section 120 as separate pieces, which each include the bottom channel 130 (not shown) for seating onto the rim of the cremation container 102. The right side section 122 of the frame 104 is provided as two separate pieces, including a shoulder portion 132 and a leg portion 134. Both the shoulder portion 132 and the leg portion 134 include the groove 126, e.g., for receiving the right tongue 114 of the canopy 106 or other lid feature if desired, and a bottom channel 130 (not shown) for receiving the rim of the right side panel of the cremation container 102. However, the groove 126 is not necessarily required on the shoulder portion 132 of the right side section 122, e.g., if the right tongue 114 of the canopy 106 fits completely into the top groove 126 of the lower portion 134 of the right section 122.

Analogously to the right side section 122, the left side section 124 of the frame 104 is provided as two separate pieces, including a shoulder portion 136 and a leg portion 138. Both the shoulder portion 136 and the leg portion 138 include the groove 128 for receiving the left tongue 116 of the canopy 106 or other lid feature if desired, and a bottom channel 130 (not shown) for receiving the rim of the left side panel of the cremation container 102. However, the groove 128 is not necessarily required on the shoulder portion 136 of the left side section 124, e.g., if the left tongue 116 of the canopy 106 fits completely into the top groove 126 of the lower portion 134 of the right section 122.

As shown in the exemplary frame 104 of FIG. 4A, the head end section 118 does not include a top groove. Likewise, the foot end section 120 does not include a top groove. However, as with the left and right sections 122, 124, the head and foot sections 118, 120 may include the top groove, e.g., to fit a corresponding end tongue (not shown) of the canopy 106 or other feature where such a feature is implemented.

In some embodiments where the right and left sections 122, 124 are each divided into two separate portions 132, 134, 136, 138, the canopy 106 may be longer than the length of the leg portions 134, 138 so that when the canopy 106 is coupled with the frame 104, the canopy 106 overlaps over the shoulder portions 132, 136. This overlapping helps improve the stability of the kit 100 when assembled and helps to reduce any squeaking that may occur when sections of the frame 104 rub against each other, such as where the frame 104 is constructed from foam.

As a few illustrative alternative configurations, the frame 104 can be implemented using two U-shaped sections, where the shoulder portions 132, 136 are integrated with the head end section 118 and the leg portions 134, 138 are integrated with the foot end section 120. As another illustrative example, the frame 104 can be implemented as two L-shaped sections, e.g., where the right side section 122 is integrated with the head end section 118 and the left side section 124 is integrated with the foot end section 120. Still further, the frame 104 can be implemented as a unitary frame 104 as shown in FIG. 2, four separate sections defined along the head end section 118, the foot end section 120, the right side section 122, and the left side section 124. Yet further, other alternative implementations may be implemented to break-up of the frame 104 into two or more pieces.

Further, the separate sections of the frame 104 can buttress against each other and/or connect together using suitable techniques. For instance, the frame pieces can buttress in any way, including, but not limited to straight lines at right angles as shown between the shoulder and leg portions 132, 134, straight lines at forty-five degree angles, as shown between the head end section 118 and the shoulder portions 132, 136 other angles, etc. The pieces of the frame 104 can also be connected, e.g., using pins, connectors, tongue and groove, etc.

According to further aspects, the kit can include at least one key that temporarily assembles the frame 104 and/or canopy 106 over the cremation container 102.

Figure 4B:
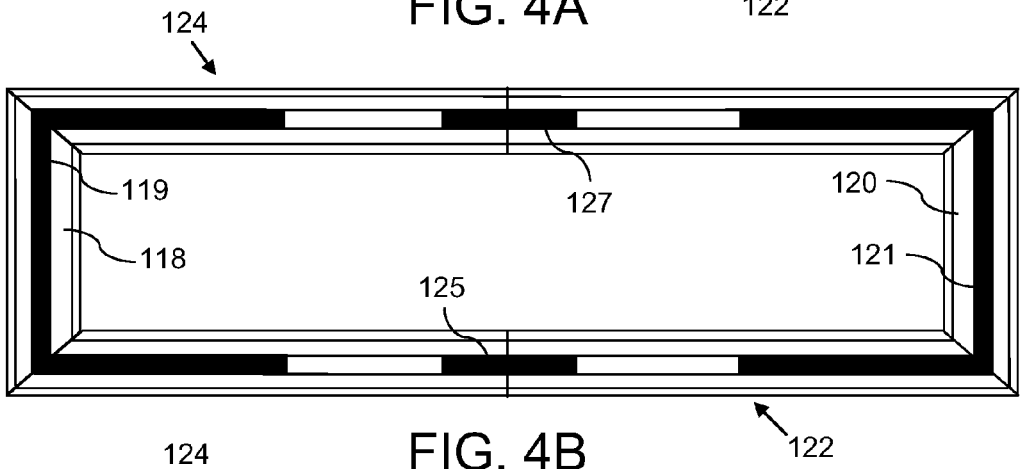
FIG. 4B is a top view of an exemplary frame of the kit, where the frame sections are assembled together using keys, according to further aspects of the present invention.

Referring to FIG. 4B, in some embodiments, the head end section 118 and the leg end section 120 of the frame 104 includes a groove along the top surface thereof, similar to that set forth above for the right and left side sections 122, 124. In this regard, a first U-shaped key 119 fits into the groove of the head end section 118, the groove 126 of the right shoulder portion 132 of the right side section 122, and the groove 128 of the left shoulder portion 136 of the left side section 124. A second U-shaped key 121 fits into the groove of the foot end section 120, the groove 126 of the right leg portion 134 of the right side section 122, and the groove 128 of the left leg portion 138 of the left side section 124. The keys 119, 121, when seated, can sit so that the top of the keys 119, 121 are flush with the top surfaces of the frame sections 104. Additionally, a key 125 is inserted into the groove 126 to join the shoulder portion 132 and the leg portion 134 of the right side section 122. Analogously, a key 127 is inserted into the groove 128 to join the shoulder portion 136 to the leg portion 138 of the left side section 124.

The keys 119, 121, 125, 127 may be made of aluminum or any other suitable material and provide a more stable frame structure when the frame 104 is assembled. In this regard, the keys 119, 121, 125, 127 can couple their respective frame pieces together in any reasonable manner, e.g., to form a structurally stable connection, to prevent squeaks, etc.

Figure 4C:
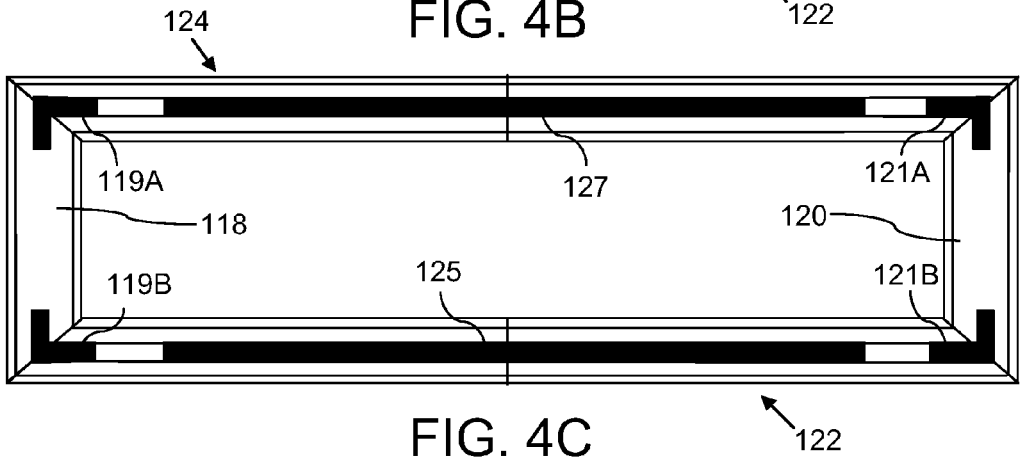
FIG. 4C is a top view of an exemplary frame of the kit, where the frame sections are assembled together using keys, according to yet further aspects of the present invention.

Referring to FIG. 4C, another exemplary frame 104 is illustrated. This example is analogous to that of FIG. 4B, except that the keys are in different configurations. For instance, the head end section 118 is coupled to the right and left side sections 122, 124 using keys 119A and 119B respectively. Analogously, the foot end section 120 is coupled to the right and left side sections 122, 124 using keys 121A and 121B, respectively. The shoulder and leg portions of the right and left side members 122, 124 are coupled together using one or more keys 125, 127 that are longer than the same keys of FIG. 4B. Again the keys can sit flush with the top surface of the sections of the frame 104, but need not do so.

Figure 4D:
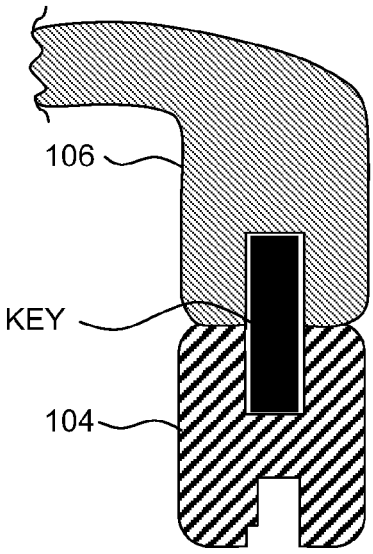
FIG. 4D is a cross-sectional view of an exemplary frame of the kit, illustrating a key temporarily connecting a canopy to the frame, according to various aspects of the present invention.

Referring to FIG. 4D, one or more of the keys can extend above the plane of the top surface of the frame 104. In this arrangement, the tongues 114, 116 of the canopy can be replaced with grooves or slots that allow the canopy 106 to sit down over the key. As yet further examples, the keys can couple the respective frame and canopy pieces together using any other suitable manner. As yet another illustrative example, a single rectangular key can be utilized to temporarily join the head end section, foot end section and side sections of the frame 104.

The frame 104 may be made of any suitable material such as foam, e.g., a closed-cell extruded polystyrene foam. The frame 104 may alternatively be constructed from other materials, such as plastic, particle board, cardboard, etc. Along those lines, because the cremation container bears the weight of the frame 104 and the rest of the kit 100, the frame 104 is preferably made out of a lightweight material. If the material used is foam, the separate pieces may be sprayed with paint or a lubricant to reduce any squeaking that may occur if the separate pieces rub together. Further, the keys can be used to create barriers or to form tight connections that prevent squeaking, moving and other undesirable effects of assembling the frame 104 over the cremation container 104.

Figure 5:
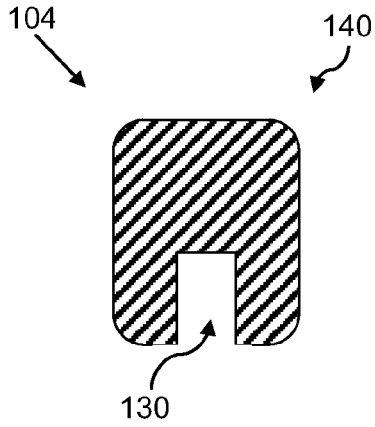
FIG. 5 is a cross-sectional view of an exemplary embodiment of the frame of the kit, according to various aspects of the present invention.

Turning now to FIG. 5, an exemplary cross-section 140 of a section of the frame 104 illustrates a bottom channel 130 and no top groove. This cross section 140 may be used on sections of the frame 104 that do not require a top groove, such as the head end section 118, the foot end section 120, the shoulder portion 132 of the right side section 122, and the shoulder portion 136 of the left side section 124, depending upon the implementation.

Figure 6A:
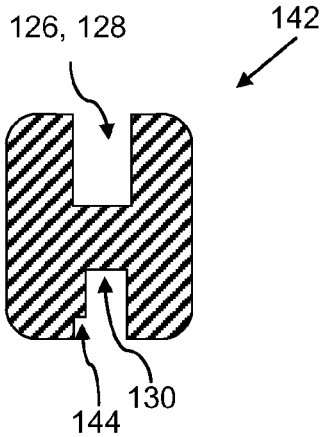
FIG. 6A is a cross-sectional view of another exemplary embodiment of the frame of the kit, where the channel implements a U-shape, according to various aspects of the present invention.

Turning now to FIG. 6A, an exemplary cross-section 142 of an alternative section of the frame 104 illustrates a top groove 126, 128 as described above, e.g., for receiving a corresponding tongue of a canopy 106, a key 119, 121, 125, 127, lid or other structure. The cross section 142 also includes a bottom channel 130 as described more fully herein. The illustrated channel 130 takes the form of a U-shape in that it has two side walls. Moreover, the illustrated cross-section 142 also includes a notch 144 in the channel 130 for mating with a support shell (see FIG. 8 below). Such a cross section may be used, for example, on the leg portions 134, 138 of the right and left side sections, respectively when the cremation container 102 includes the support shell. The notch 144 in the bottom channel 130 may also be used on frame sections without a top groove. Still alternatively, the bottom channel 130 may be dimensioned to contain both the rim of the cremation container 102 and the support shell, which is described in greater detail below.

Figure 6B:
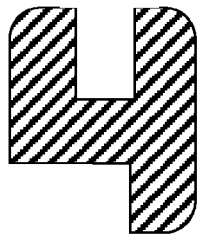
FIG. 6B is a cross-sectional view of another exemplary embodiment of the frame of the kit, where the channel implements an L-shape, according to various aspects of the present invention.

Referring to FIG. 6B, the cross-section 142 is analogous to that of FIG. 6A, except that the channel 130 is generally L-shaped. That is, there is only one side wall. This side wall may push against either the inside or outside of the cremation container 102, depending upon the implementation.

Figure 7A:
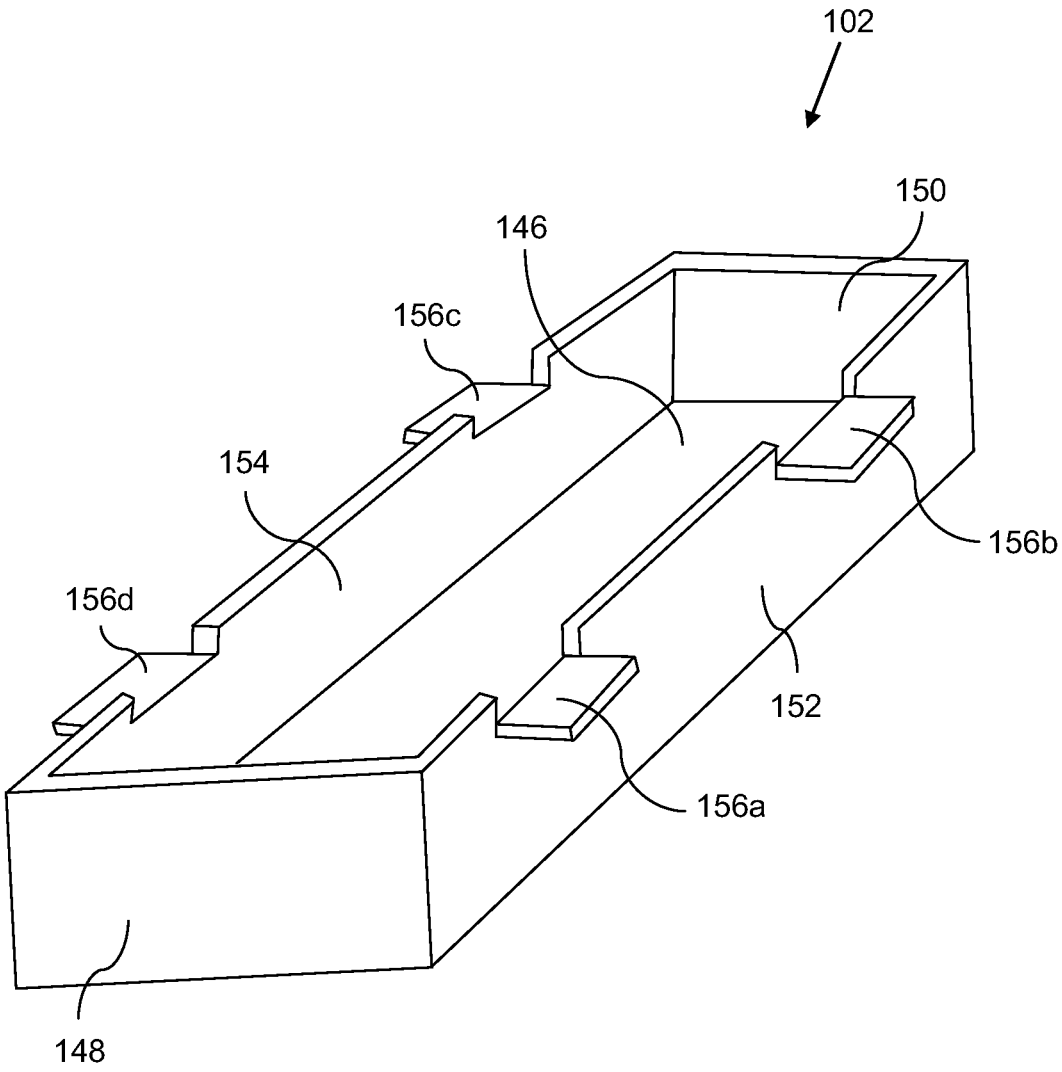
FIG. 7A is an isometric view of an exemplary embodiment of a cremation container, according to various aspects of the present invention.

FIG. 7A illustrates an exemplary cremation container 102. Most cremation containers are a simple box made of cardboard, particle board, or a similar material, and the kit 100 (FIG. 1) can be used with that type of simple cremation container or any other type of cremation container. The exemplary cremation container 102 is made of cardboard and includes a bottom 146, a head panel 148, a foot panel 150, a left panel 152, and a right panel 154, which create an interior of the cremation container 102. Additionally, the exemplary cremation container 102 includes fold-out tabs 156*a-d* that create a surface upon which a cremation container lid (not shown) can rest.

The cremation container lid is preferably slightly longer and wider than the cremation container 102 for easy assembly on the cremation container 102. Even though the exemplary cremation container 102 includes four fold-out tabs 156*a-d*, any number of fold-out tabs 156 may be included on the cremation container 102.

Figure 7B:
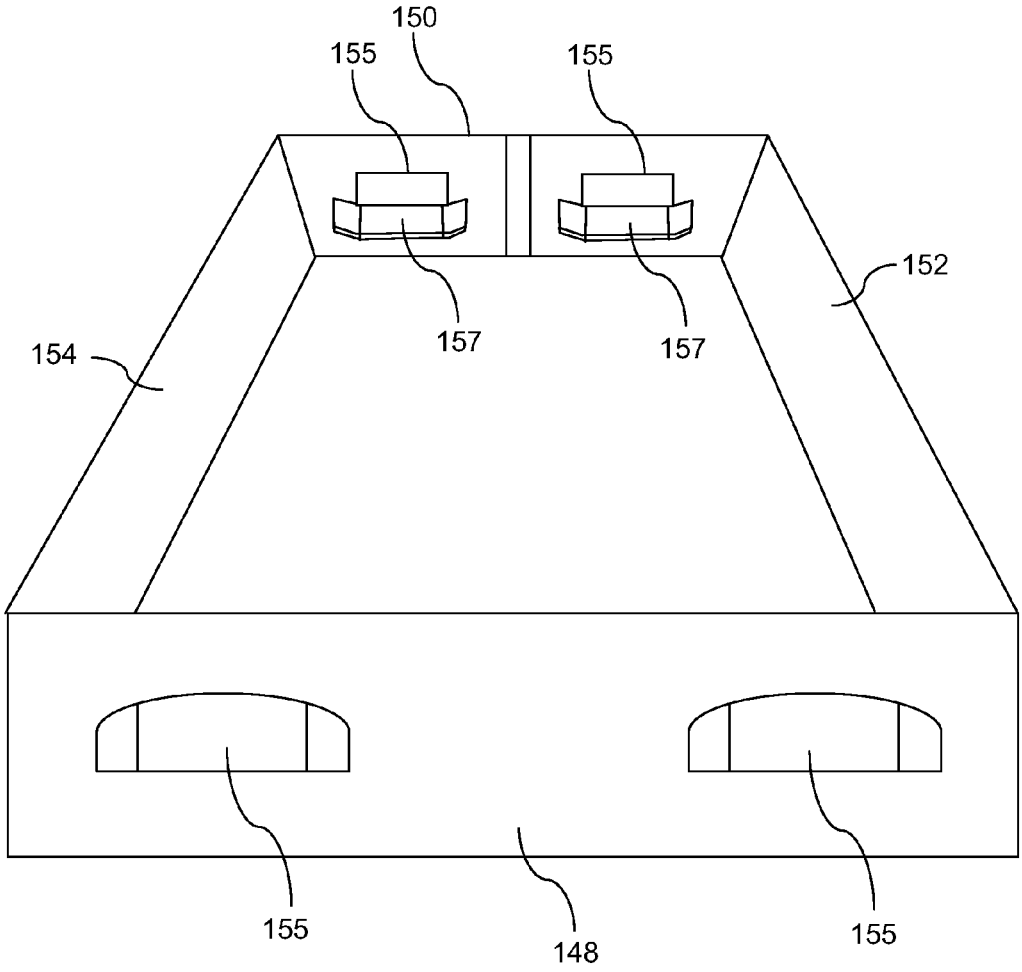
FIG. 7B is an isometric view of an exemplary embodiment of a cremation container, according to further aspects of the present invention.

Referring to FIG. 7B, the cremation container 102 is analogous to the cremation container of FIG. 7A. However, instead of using foldout tabs that fold out to the outside of the cremation container 102 along the sides thereof, there are handles 155 and corresponding tabs 157 at the head and foot end sections 148, 150 that fold inward. Handles 155 and corresponding tabs 157 can also and/or alternatively be placed along the sides 152, 154 of the cremation container 102. Still further, aspects of FIGS. 7A and 7B can be combined, e.g., by using a combination of handles and fold-out tabs, either to the outside or inside of the cremation container 102.

Figure 8:
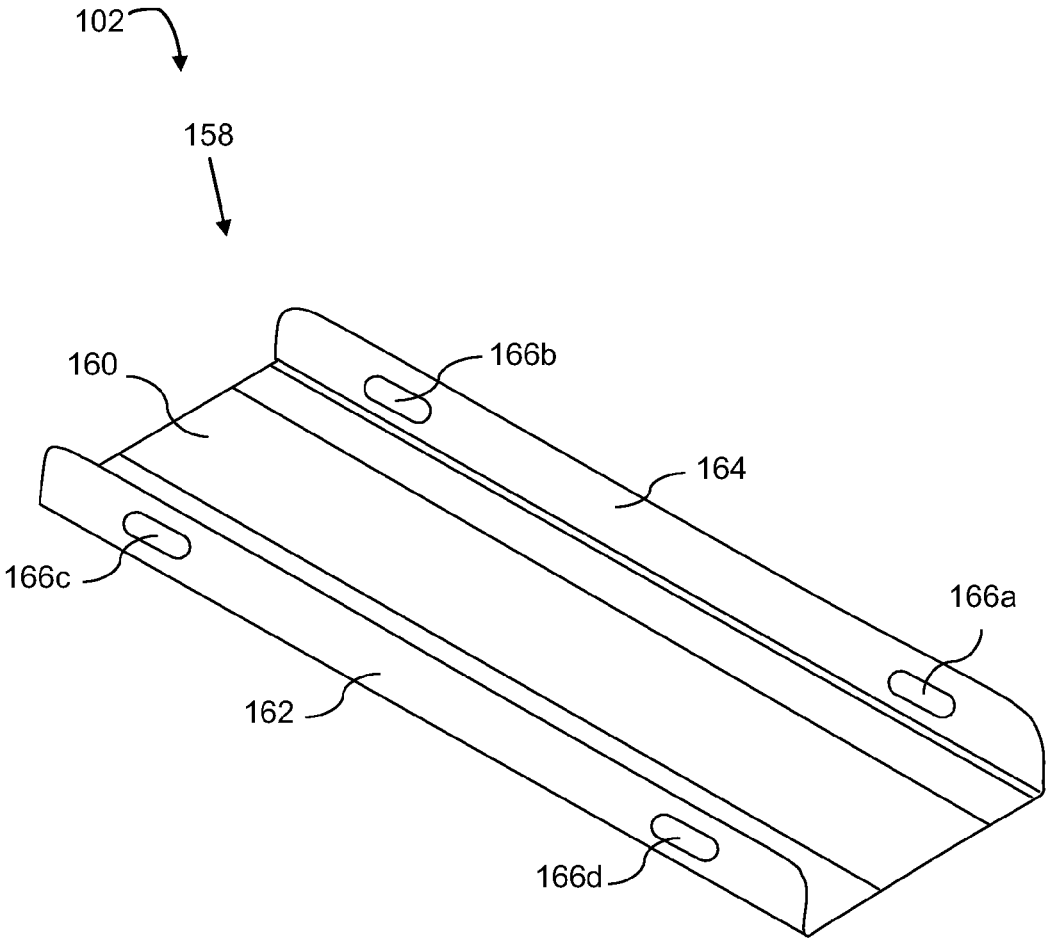
FIG. 8 is an isometric view of a shell for the cremation container, according to various aspects of the present invention.

FIG. 8 illustrates a support shell 158 for use with an exemplary cremation container 102. The U-shaped support shell 158 includes a bottom 160, a left sidewall 162, and a right sidewall 164. When the cremation container 102 is seated in the support shell 158, the left sidewall 162 of the support shell 158 aligns adjacent to the left side panel of the cremation container 102 and the right sidewall 164 of the support shell 158 aligns adjacent to the right side panel of the cremation container 102. Referring generally to FIGS. 6A and 8, when the left side section of the frame 104 is installed on the cremation container 102, the channel 130 receives the rim of the cremation container 102 and the cutout 144 receives the left sidewall 162 of the support shell 158. Similarly, when the right side section of the frame 104 is installed on the cremation container 102, the channel 130 receives the rim of the cremation container 102 and the cutout 144 receives the right sidewall 164 of the support shell 158.

The left and right sidewalls 162, 164 also include hand holes 166*a-d* for people to grab onto when transporting the cremation container 102 with the body or the cremation process. The support shell 158 can be integrated into the cremation container 102 or be separate from the cremation container 102. The support shell 158 reinforces the left panel 152, right panel 154, and bottom 146 (FIGS. 7A-7B) of the cremation container 102.

The exemplary support shell 158 is illustrated with four hand holes 166*a-d*, but any number of hand holes 166 may be included. In embodiments with a support shell 158, the bottom channel 130 of the frame 104 (FIG. 2) can include the notch 144 (FIG. 6A) if the left and right sides 162, 164 of the support shell 158 extend up into where the frame 104 would attach. The notch 144 is deep enough into the frame 104 to accommodate the support shell 158. Moreover, the support shell 158 may be made of any material including, but not limited to aluminum, etc. The support shell 158 does not come into contact with the body of the deceased, and thus may be re-used. Moreover, the support shell 158 is used to provide structural integrity to the display. In this regard, the support shell 158 need not extend the entirety of the length (L) of the cremation container 102. Having a shorter support shell 158 may assist with sliding the cremation container 102 into and out of the support shell 158. Also and/or alternatively, since the cremation container 102 slides into the support shell 158 from an end thereof, the support shell 158 may include rollers or other features to assist in inserting the cremation container 102 through the support shell 158.

Figure 9:
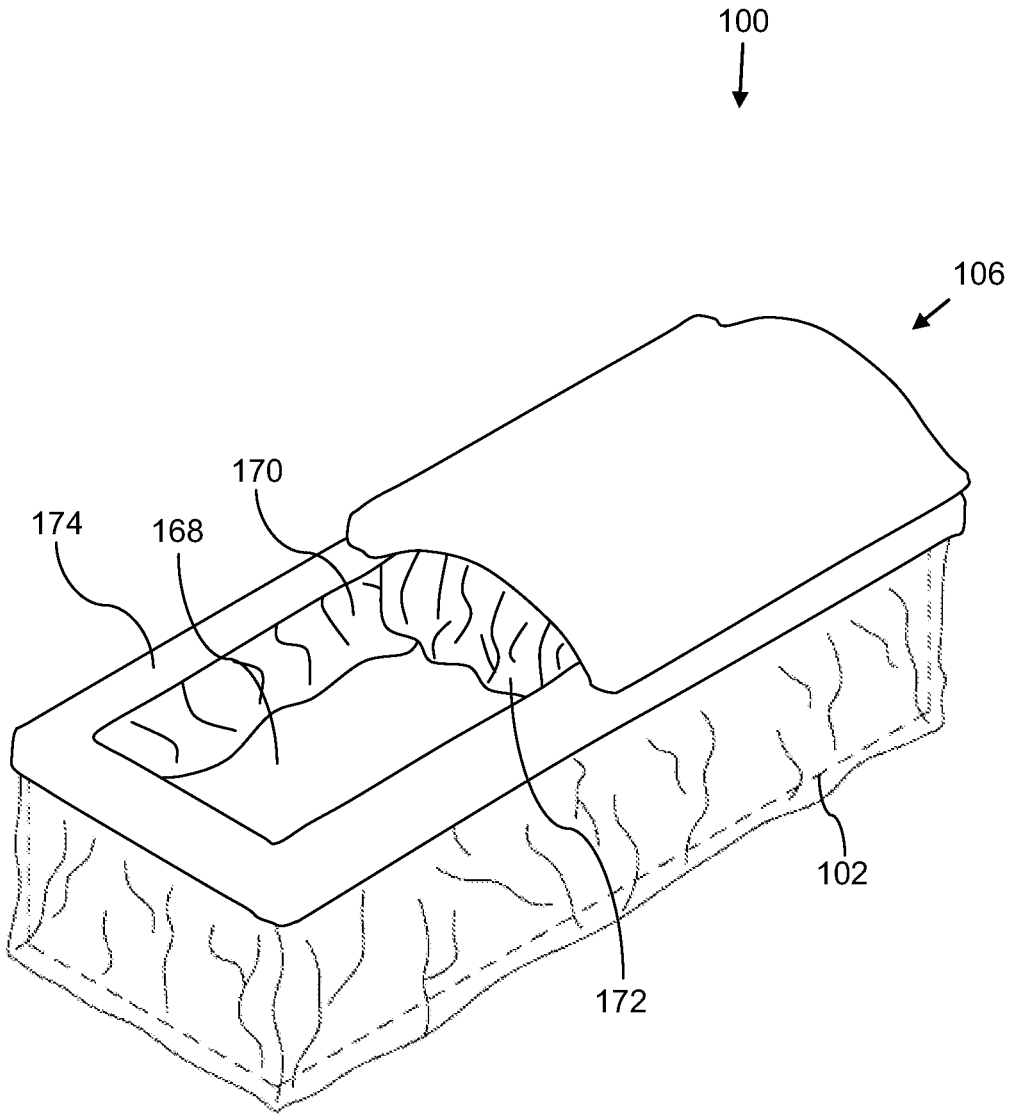
FIG. 9 is an isometric view of the kit assembled with liners and a skirt, according to various aspects of the present invention.

Referring now to FIG. 9, the kit 100 includes a bottom liner 168 that is placed inside the cremation container 102 to conceal at least the bottom 146 (FIG. 7A) portion of the cremation container 102 that is not concealed by the canopy 106. Further, the kit 100 includes a sidewall liner 170 that conceals the inside panels 148, 152, 154 (FIG. 7A) of the cremation container 102. A cap 174 is placed over the top surface of the frame 104 to conceal the groove (if provided). The sidewall liner 170 may be coupled to the frame 104, cap 174 or the cremation container itself, using any suitable method including, but not limited to friction, hook and loop fastener, snaps, zippers, etc.

Also included in the exemplary kit 100 of FIG. 9 is a curtain 172 that couples to the canopy 106 and hangs down to conceal the interior of the cremation container 102 covered by the canopy 106. Similar to the sidewall liner 170, the curtain may be coupled to the canopy 106 in any suitable manner including for example, friction, hook and loop fastener, snaps, zippers, etc.

Figure 10:
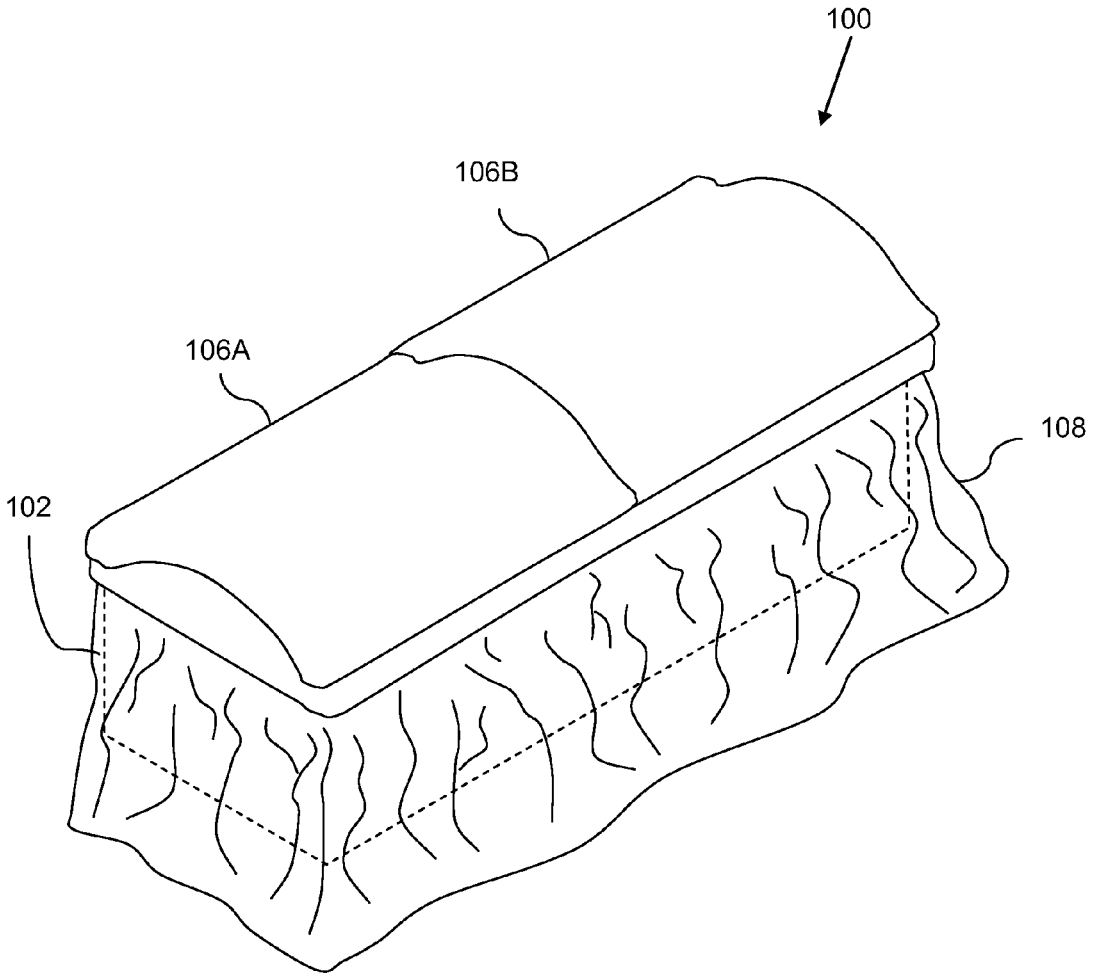
FIG. 10 is an isometric view of the kit assembled with liners and a skirt, according to further aspects of the present invention.

FIG. 10 illustrates an exemplary embodiment of the kit 100, wherein the skirt 108 is longer than the depth of the cremation container 102 to conceal a pedestal (not shown) or an elevation device upon which the cremation container 102 rests. Also, two canopies 106A, 106B are illustrated. Two canopies may be used, for instance, where a closed viewing is desired. Alternatively, the canopy 106A that covers the upper torso of the deceased may be propped or otherwise hinged to the frame 104 to create the further aesthetic of a traditional open casket viewing.

Figure 11:
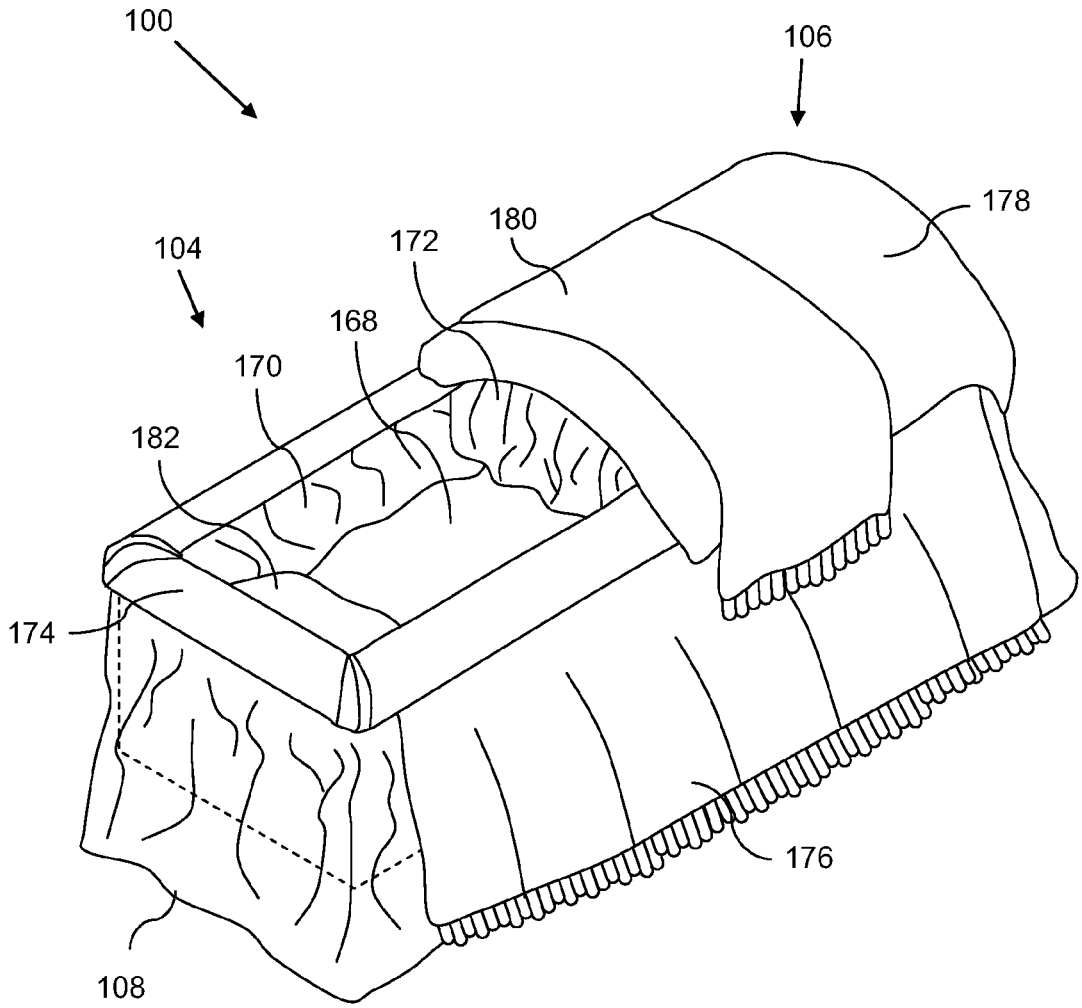
FIG. 11 is an isometric view of the kit assembled with liners, a long skirt, and panels, according to various aspects of the present invention.

FIG. 11 illustrates another exemplary embodiment of the kit 100, which includes a cap 174, a skirt panel 176, a canopy cover 178, a banner 180, and a pillow 182. The cap 174 is a U-Shaped piece of cloth that lies over the head end section 118, and shoulder portions 132, 136 of the right and left side sections 122, 124 of the frame 104 to conceal the frame 104 and any coupling devices, e.g., keys, etc., which couple to the frame 104. For instance, the cap 174 can conceal the attachment of the sidewall liner 170 to the frame 104. For instance, the sidewall liner 170 can attach, such as by using hook and loop fastener, to the cap 174. The skirt panel 176 couples to the skirt 108 of the kit 100 using any suitable method, e.g., hook and loop fastener, snaps, zipper, etc., and provides a decorative touch to the kit 100. The canopy cover 178 is a piece of cloth that lies on top of the canopy 106 and conceals the top of the canopy 106. Further, the banner 180 drapes over the canopy cover 178 to provide a decoration or personalization to the kit 100. For example, the banner, skirt panel, or both may include the United States Naval Seal if the deceased was in the Navy.

In states that have laws including a provision that any item that touches a body must be buried or destroyed, only the bottom liner 168, sidewall liner 170, curtain 172, and pillow 182 need to be destroyed in the cremation process. Everything else should be re-usable.

Referring now to the drawings in general, to use the exemplary kit 100 to transform a cremation container 102 for display, a user follows these exemplary steps in any rational order. In this example, the cremation container 102 lies on a pedestal, dolly or other suitable support structure. If the user wants to raise the body for display, the user can place a spacer such as a foam riser between the cremation container 102 and the support structure. For instance, according to certain aspects of the present invention, the cremation container may be shallow, e.g., having a height of 6-7 inches, approximately 15.2-17.8 centimeters (cm). As such, a 10 inch, approximately 25.4 cm, foam riser block can be used to space the cremation container 102 from the underlying support structure. In some deeper cremation containers 102, the user can place the riser inside the cremation container 102 if the user so desires. In this instance, the riser should be burnable.

The user places the bottom liner 168 and pillow 182 inside the interior of the cremation container 102 and lays the body of the deceased into the cremation container 102. Then, the user attaches the skirt 108. For instance, the user may unwind the skirt 108 from a folding template (explained in greater detail below in reference to FIGS. 12-14) and attaches the skirt 108 to the cremation container 102. Then, the user places the frame 104 sections 118, 120, 122, 124 in their proper places on the rim of the cremation container 102 and couples the canopy 106 to the frame 104 as described above. Next, the user attaches the sidewall liner 170 to the frame 104 and covers the portion of the frame 104 not covered by the canopy 106 with the cap 174. The user then lays the canopy cover 178 over the canopy 106 and attaches the curtain 172 to the canopy 106, the canopy cover 178, or both. Then, the user attaches the skirt panel 176 to the skirt 108 and lays the banner 180 over the canopy cover 178.

Thus, the user has transformed a cremation casket 102 into a faux casket for display at a memorial service. Most, if not all, of the weight of the kit 100 is supported by the cremation container 102 itself.

After the memorial service, the user removes everything except the parts of the kit 100 that have touched the body. The parts that typically touch the body include the cremation container 102, bottom liner 168, sidewall liner 170, canopy curtain 174 and pillow 182. The remaining (removed) parts can be reused. The parts of the kit 100 that touched the body get cremated along with the deceased.

Figure 12:
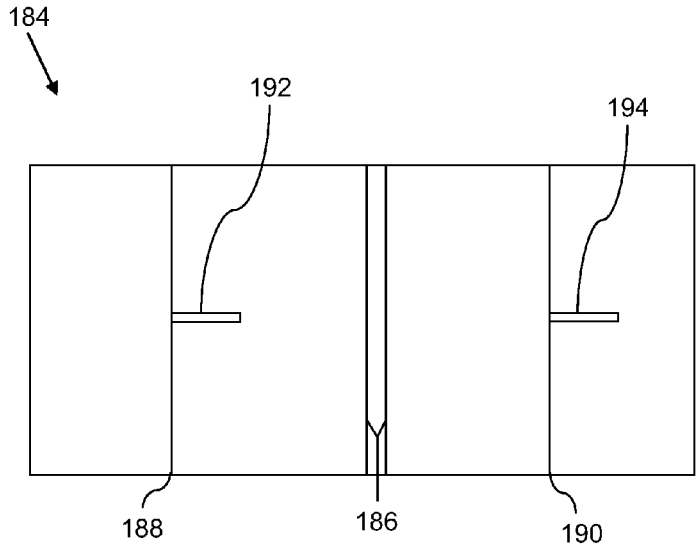
FIG. 12 is an unfolded view of a folding template for a skirt of the kit, according to various aspects of the present invention.
Figure 13:
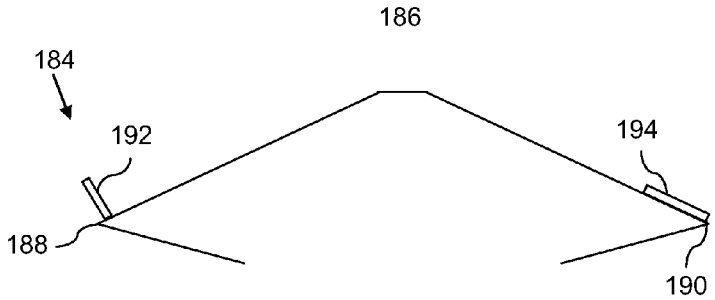
FIG. 13 is a partially folded view of the folding template for a skirt of the kit, according to various aspects of the present invention.
Figure 14:
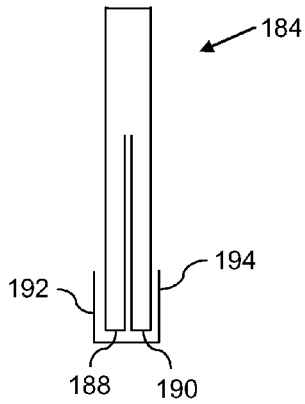
FIG. 14 is a fully folded view of the folding template for a skirt of the kit, according to various aspects of the present invention.

Referring now to FIGS. 12-14, a folding template 184 for the skirt 108 is shown. FIG. 12 illustrates the folding template 184 when it is opened flat; FIG. 13 illustrates the folding template 184 when it is partially folded; and FIG. 14 illustrates the folding template 184 when it is folded for storage. Referring specifically to FIG. 12, the folding template 184 includes a dual spline 186 down its center, another spline 188 parallel to the center spline 186 between the center spline 186 and a left end of the folding template 184, and a third spline 190 parallel to the center spline 186 between the center spline 186 and a right end of the folding template 184. Attached to the outside of the left spline 188 is a coupler 192 such as a hook, button, snap, etc., and attached to the outside of the right spline 190 is a coupler 194 complementary to the coupler 192 on the left spline 188 such as a loop fastener, button hole, snap receptacle, etc.

Referring to FIG. 13, the user places the skirt 108 on the folding template 184 and folds along the left and right splines 188, 190 such that the couplers 192, 194 are on the outer edges of the folding template 184. Referring now to FIG. 14, the user then folds the folding template 184 along the dual spline 186 and connects the couplers 192, 194 together and stores the skirt 108 for later use. In such a way, only one user is needed to fold the skirt 108 for wrinkle-resistant storage.

In an exemplary embodiment, the folding template 184 is 126 inches (approx. 320 centimeters (cm)) wide and 22 inches (approx. 56 cm) in height. The left and right splines 188, 190 are 25 inches (approx. 63.5 cm) from their respective edges, and the dual spline is ¾ inch (approx. 1.9 cm) wide.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. A kit for transforming a cremation container for display, the kit comprising:

a frame including a head end section, a right side section, and a left side section, each section including a bottom surface and a continuous channel along the bottom surface, wherein the frame seats over the cremation container such that:

the channel of the head end section receives a rim of an end panel of the cremation container;

the channel of the right side section receives a rim of a right side panel of the cremation container;

the channel of the left side section receives a rim of a left side panel of the cremation container; and a canopy that temporarily overlies at least a portion of the cremation container and detachably couples to the frame.

2. The kit of claim 1, wherein the frame does not touch or extend below a bottom panel of the cremation container.

3. The kit of to claim 1, wherein the canopy comprises at least one tongue that temporarily seats into at least one corresponding groove in a top surface of the frame.

4. The kit of claim 1, wherein:

at least a portion of the frame includes a groove in a top surface thereof;

the canopy comprises a groove along a bottom surface thereof; and the canopy is temporarily coupled to the frame by inserting a key into the respective grooves between the canopy and the frame.

5. The kit of claim 1, wherein:

the left side section of the frame further comprises:

a shoulder portion and a leg portion, wherein the leg portion includes a groove through a top surface thereof and the right side section of the frame further comprises:

a shoulder portion and a leg portion, wherein the leg portion includes a groove through a top surface thereof.

6. The kit of claim 5, wherein:

the canopy is dimensioned so as to overlie at least a portion of the shoulder portion of the left side section and at least a portion of the shoulder portion of the right side section.

7. The kit of claim 1, wherein each section is generally balanced on the corresponding rim of the cremation container.

8. The kit of claim 1 further comprising:

a cutout in the channel of the left side section of the frame;

a cutout in the channel of the right side section of the frame;

wherein:

the cremation container is seated in a support shell having a left sidewall adjacent to the left side panel of the cremation container and a right sidewall adjacent to the right side panel of the cremation container;

when the left side section is installed on the cremation container, the channel thereof receives the rim of the left side panel of the cremation container and the cutout thereof receives the left sidewall of the support shell; and when the right side section is installed on the cremation container, the channel thereof receives the rim of the right side panel of the cremation container and the cutout thereof receives the right sidewall of the support shell.

9. The kit of claim 1 further comprising:

a skirt comprising:

a left section that couples to the rim of the left side panel of the cremation container beneath the channel of the left side section of the frame, such that at least a portion of the left section of the skirt is between the cremation container and the frame; and a right section that couples to the rim of the right side panel of the cremation container beneath the channel of the right side section of the frame, such that at least a portion the right section of the skirt is between the cremation container and the frame; and a cap that covers the head end of the frame, at least partially covers the left section of the frame, and at least partially covers the right section of the frame.

10. The kit of claim 9 further comprising:

a liner that at least partially covers an interior of the cremation container;

a pillow sized to fit in the interior of the cremation container;

a curtain that couples to the canopy such that the curtain hangs into the cremation container;

a canopy cover that drapes over the canopy;

a banner that drapes over the canopy cover; and a skirt panel coupled to the skirt.

11. The kit of claim 1 further comprising:

a head canopy comprising at least one tongue that temporarily seats into at least one corresponding groove in a top surface of the frame.

12. The kit of claim 1, wherein:

the frame and canopy are comprised of foam;

further comprising at least one key that temporarily assembles the frame and canopy over the cremation container.

13. A system for presenting a body, the system comprising:

a cremation container including:

a bottom;

a left side panel coupled to the bottom;

a right side panel coupled to the bottom;

a head end panel coupled to the bottom and coupled between the left side panel and the right side panel; a foot end panel coupled to the bottom and coupled between the left panel and the right panel;

wherein the bottom is coupled to the left side panel, right side panel, head end panel, and foot panel such that an interior space is created in the cremation container;

a frame including a head end section, a right side section, and a left side section, each section including a bottom surface and a continuous channel along the bottom surface, wherein the frame seats over the cremation container such that:

the channel of the head end section receives a rim of the head end panel of the cremation container;

the channel of the right side section receives a rim of a right side panel of the cremation container;

the channel of the left side section receives a rim of a left side panel of the cremation container; and a canopy that temporarily overlies at least a portion of the cremation container and detachably couples to the frame.

14. The system of claim 13, wherein the cremation container further includes:

a lid; and a plurality of fold-out tabs that support the lid.

15. The system of claim 13, wherein the cremation container further includes a U-shaped support shell that reinforces:

the left side panel of the cremation container;

the right side panel of the cremation container; and the bottom of the cremation container.

16. The system of claim 15, wherein:

the channel of the left side section includes a cutout that couples to the support shell; and the channel of the right side section includes a cutout that couples to the support shell.

17. The system of claim 13, wherein:

the left side section of the frame further comprises:

a shoulder portion and a leg portion, wherein the leg portion includes a groove through a top surface thereof; and the right side section of the frame further comprises:

a shoulder portion and a leg portion, wherein the leg portion includes a groove through a top surface thereof;

wherein the canopy is dimensioned so as to overlie at least a portion of the shoulder portion of the left side section and at least a portion of the shoulder portion of the right side section.

18. The system of claim 13 further comprising:

a skirt comprising:

a left section that couples to the rim of the left side panel of the cremation container beneath the channel of the left side section of the frame, such that at least a portion of the left section of the skirt is between the cremation container and the frame; and a right section that couples to the rim of the right side panel of the cremation container beneath the channel of the right side section of the frame, such that at least a portion the right section of the skirt is between the cremation container and the frame;

a cap cloth that covers the head end section of the frame, at least partially covers the left side section of the frame, and at least partially covers the right side section of the frame.

a liner that at least partially covers the interior of the cremation container;

a pillow sized to fit in the interior of the cremation container;

a curtain that couples to the canopy such that the curtain hangs into the cremation container;

a canopy cover that drapes over the canopy;

a banner that drapes over the canopy cover; and a skirt panel coupled to the skirt.

* * * * *